US006139265A

United States Patent [19]

Alizadeh

[11] Patent Number: 6,139,265

[45] Date of Patent: Oct. 31, 2000

[54] STATOR FAN

[75] Inventor: Ahmad Alizadeh, Indianapolis, Ind.

[73] Assignee: Valeo Thermique Moteur, Le Mesnil-Saint-Denis, France

[21] Appl. No.: 08/640,457

[22] Filed: May 1, 1996

[51] Int. Cl.[7] ..... F04D 29/54

[52] U.S. Cl. ..... 415/208.1; 415/208.3; 415/914

[58] Field of Search ..... 415/119, 208.1, 415/191, 192, 208.2, 208.3, 914, 181

[56] References Cited

U.S. PATENT DOCUMENTS

| | | | |
|---|---|---|---|
| 2,154,313 | 4/1939 | McMahan | 415/191 |
| 2,224,519 | 12/1940 | McIntyre | 415/192 |
| 2,524,869 | 10/1950 | Adamtchik | 415/192 |
| 4,208,167 | 6/1980 | Yasugahira et al. | 415/191 |
| 4,548,548 | 10/1985 | Gray, III . | |
| 4,563,622 | 1/1986 | Deavers et al. . | |
| 4,636,669 | 1/1987 | Plunkett et al. | 415/119 |
| 5,066,194 | 11/1991 | Amr et al. | 415/208.2 |
| 5,342,167 | 8/1994 | Rosseau | 415/119 |
| 5,460,485 | 10/1995 | Sugiyama et al. | 415/119 |
| 5,466,120 | 11/1995 | Takeuchi et al. | 415/119 |
| 5,577,888 | 11/1996 | Capdevila et al. . | |

*Primary Examiner*—John Kwon
*Attorney, Agent, or Firm*—Morgan & Finnegan, LLP

[57] ABSTRACT

A stator assembly for a fan has a passage member which defines a passage for air flow due to the fan, a fan mount for the fan and at least one support arm extending between the passage member and the fan mount. A plurality of air flow directing members extend between the passage member and the fan mount. The passage member is preferably ring shaped and the fan mount is concentric with the ring. The air flow directing members may be straight, or skewed with respect to the direction of rotation of the fan. Different forms of the air flow directing members are described.

12 Claims, 16 Drawing Sheets

STATOR FAN

FIELD OF THE INVENTION

The present invention relates to a stator assembly for a fan and to a fan device comprising a fan and a stator assembly, and to a fan assembly for moving air through a heat exchanger and the like.

BACKGROUND TO THE INVENTION

The use of fans to move air through heat exchangers is well known, for example in the field of air conditioning and the field of motor vehicle cooling. A fan for such an application may consist of a hub member and plural blade members, each blade member having a root portion and a tip portion, the root portions of each blade being secured to the hub portion such that the blades extend substantially radially of the hub portion. A blade tip support ring may link the blades near to, or more usually, at their tip portions.

Such a fan, which is often driven by an electric motor, or via a transmission from an associated engine, is usually disposed so that the fan radial plane extends parallel to a face portion of the associated heat exchanger.

Fans of this type are commonly referred to as "axial flow fans". However, although the blades are pitched so as to move air in an axial direction, nevertheless the action of the fan causes a relatively complicated air flow. It will, for example, be apparent that rotation of the fan causes air which has passed through the fan to have a rotational component of motion, due to the movement of the blades, as well as a linear component induced by the pitch of the blades. Leakage of air around the fan blade tips (so-called tip vortices) between the high and low pressure sides of the fan may also occur.

Furthermore, the particular blade form and the particular blade disposition selected for a fan, for example the dihedral angle of the blade, the variation in pitch along the blade span or the chord length of the blade (taken along a radial cross section) will affect the pressure distribution provided immediately adjacent the fan, and hence will affect the flow of air which has passed through the fan.

A fan of the type used to move air through a heat exchanger is intended to provide air flow in an axial direction; components in other directions are wasteful of energy. Such wasteful components of air flow impinge upon the various mechanical structures around the heat exchanger and upon the heat exchanger itself to increase the overall noise produced by the system.

It is accordingly an object of the present invention to at least partially mitigate the above mentioned difficulties.

SUMMARY OF THE INVENTION

According to a first aspect of the invention there is provided a stator assembly for a fan, comprising a passage member defining a passage for flow of air due to the fan, a fan mount for the fan, at least one support arm extending between the passage member and the fan mount for supporting the fan mount with respect to the passage, and a plurality of air flow directing members extending between the passage member and fan mount.

Conveniently the passage member is an outer ring member, thereby defining a circular air flow passage and the fan mount is substantially concentric within said outer ring member.

Advantageously the fan mount is a substantially annular inner ring member for supporting a drive shaft of the fan.

Conveniently the fan comprises an electric motor having the drive shaft, and the inner ring member engages a portion of the electric motor.

Preferably chords of each air flow directing member make respective acute angles with a plane transverse to the passage and orthogonal to the fan axis.

Advantageously the acute angles vary along the air flow directing member.

Preferably each air flow directing member has a transverse cross-section of concavo-convex form.

Preferably each air flow directing member has a chord length which varies therealong.

Conveniently the chord length of each air flow directing member is substantially constant over the inner 50% of the member, and increases over the remainder.

Advantageously at least one support arm consists of one support arm only, and the support arm is adapted to carry electrical wiring for the fan drive motor.

Alternatively, there is provided a plurality of support arms, and at least one of the support arms is adapted to carry electrical wiring for the fan drive motor.

In one embodiment, a projection of each air flow directing member onto the plane transverse to the passage and orthogonal to the fan axis has a medial line which extends radially of the passage, and respective edges which are mirror symmetrical about medial line.

In another embodiment, a projection of each air flow directing member onto the plane transverse to the passage and orthogonal to the fan axis has a medial line which curves with respect to a respective radius of the passage.

Advantageously, the stator assembly further comprises a support member extending between one of the air flow directing members and at least another of the air flow directing members.

Conveniently, the stator assembly further comprises at least one support ring connecting together the plurality of blade support members, and disposed between the fan mount and the outer ring member.

According to a second aspect of the present invention there is provided a fan device comprising a fan, a stationary fan surround and a fan support collar for supporting the fan with respect to the fan surround, the fan having a hub portion, plural fan blades and a fan blade support ring. Each fan blade has a root region and a tip region, the root regions of each fan blade being secured to the hub portion whereby the fan blades extend substantially radially of a fan rotational axis. The blade support ring extends through the tip regions of each fan blade, the fan surround having a portion disposed radially outward of the blade support ring and a portion extending axially beyond the fan. A prime number of air flow directing members are secured to said fan surround and extends radially inwardly from the surround to the fan support collar.

Preferably, a chord length of each air flow directing member varies along the length thereof.

Advantageously, each air flow directing member has a substantially constant chord length over about the first 50% of the distance between the fan support collar and the fan surround, and thereafter the chord length increases.

Conveniently, each fan blade has a medial line which, in the tip region, is circumferentially offset from the location of the medial line in the root region, whereby the fan blades are skewed. Each air flow directing member has a medial line which, at the fan surround is circumferentially offset from the position of the medial line in the region underlying the hub. Thus the air flow directing members are skewed, wherein the direction of the skew of the fan blades is opposite to the direction of the skew of the air flow directing member.

Preferably, each air flow directing member has a first edge region and a second edge region. The first edge region being disposed upstream, in the direction of air flow, of the second edge region and the thickness of the air flow directing member in the second edge region being greater than the thickness in the first edge region.

Advantageously, the projection of the first edge onto a plane perpendicular to the axis of rotation of the fan corresponds to the projection onto the plane of the trailing edge of each fan blade.

Conveniently, the fan support collar is adapted to support an electric motor for driving and supporting the fan.

Advantageously, the device comprises at least one support arm extending from the fan surround to the fan support collar.

Conveniently, there are provided three support arms.

Advantageously, at least one arm is of U-shaped cross-section, whereby wiring for the motor is carried within the U-shaped cross-section.

Advantageously the fan device further comprises a stator blade support ring connecting together the plurality of air flow directing members and disposed between the fan surround and the fan support collar.

According to a third aspect of the present invention there is provided a fan assembly comprising a fan, a stationary fan shroud and a fan support collar for supporting the fan with respect to the fan shroud. The fan has a hub portion, plural fan blades and a fan blade support ring, each fan blade having a root region and a tip region. The root regions of each fan blade are secured to the hub portion whereby the fan blades extend substantially radially of a fan rotational axis and the blade support ring extends through the tip regions of each fan blade. The fan shroud has a portion disposed radially outward of the fan blade support ring and a portion extending axially beyond the fan. The fan assembly further comprises a plurality of stator blades secured to the fan shroud and extending radially inwardly from the shroud to the fan support collar for directing the flow of air. The fan blades are pitched in a first rotational sense with respect to a diametric plane of the fan, and the stator blades are pitched in a second rotational sense opposite to the first rotational sense.

Preferably the pitch of the stator blades varies along the extent of the stator blades.

Advantageously the pitch of the fan blades varies along the extent of the fan blades.

Conveniently each stator blade has a transverse cross section of concavo-convex form.

Advantageously each stator blade has a chord length which varies along the extent of the stator blade.

Advantageously each stator blade has a substantially constant chord length over about the first 50% of the distance between the fan support collar and the fan shroud, and thereafter the chord length increases.

Conveniently each fan blade has a medial line which, in the tip region, is circumferentially offset from the location of the medial line in the root region, whereby the fan blades are skewed. Each stator blade has a medial line which, at the fan shroud is circumferentially offset from the position of the medial line in the region underlying the hub, whereby the stator blades are skewed. The direction of the skew of the fan blades is opposite to the direction of the skew of the stator blades.

Preferably each stator blade has a first edge region and a second edge region, the first edge region being disposed upstream, in the direction of air flow, of the second edge region. The thickness of the stator blade in the second edge region is greater than the thickness in the first edge region.

Conveniently each stator blade has a first edge region and a second edge region, the first edge region being adjacent the fan. The projection of the first edge region of the stator blade onto a plane transverse to and including the fan axis conforms to the projection onto the plane of the axially nearest portion of each fan blade.

In a modification, the second edge region has a projection onto the plane transverse to and including the fan axis which conforms to the projection of the first edge.

Advantageously the fan support collar is adapted to support an electric motor for driving and supporting said fan.

Preferably the fan assembly further comprises at least one arm extending from the fan shroud to the fan support collar.

Conveniently there are provided three arms.

Advantageously at least one arm is of U-shaped cross-section, whereby wiring for a fan drive motor is carried within the U-shaped cross-section.

Conveniently, the fan assembly further comprises at least one stator blade support ring connecting together the plurality of stator blades, and disposed between the stationary fan shroud and the fan support collar.

BRIEF DESCRIPTION OF THE DRAWINGS

Embodiments of the invention will now be described with respect to the accompanying drawings, in which.

In the figures like reference numerals refer to like parts.

DESCRIPTION OF PREFERRED EMBODIMENTS

Figure 1:
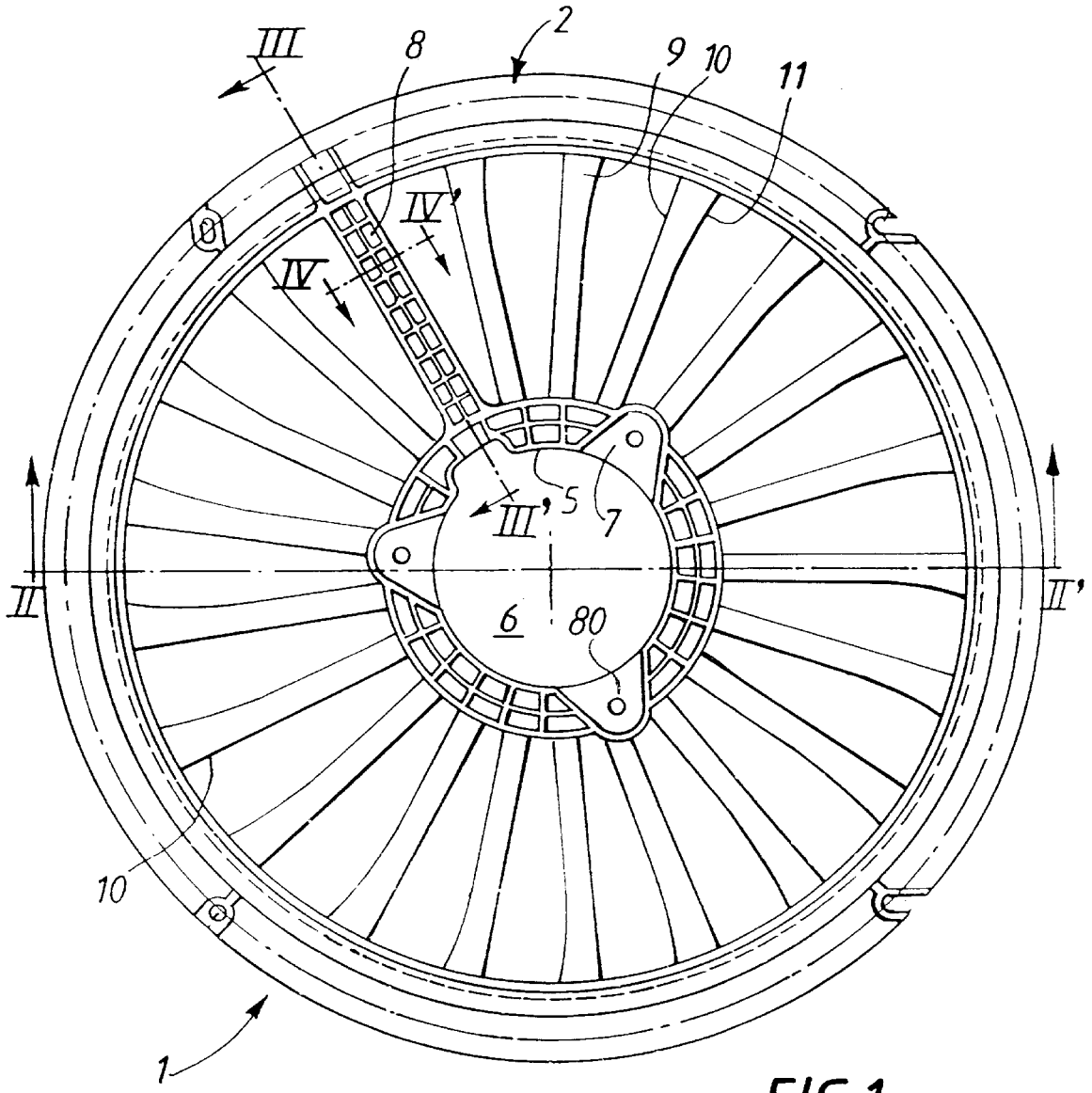
FIG. 1 shows a front elevation of a first embodiment of a stator assembly in accordance with the invention.
Figure 2:
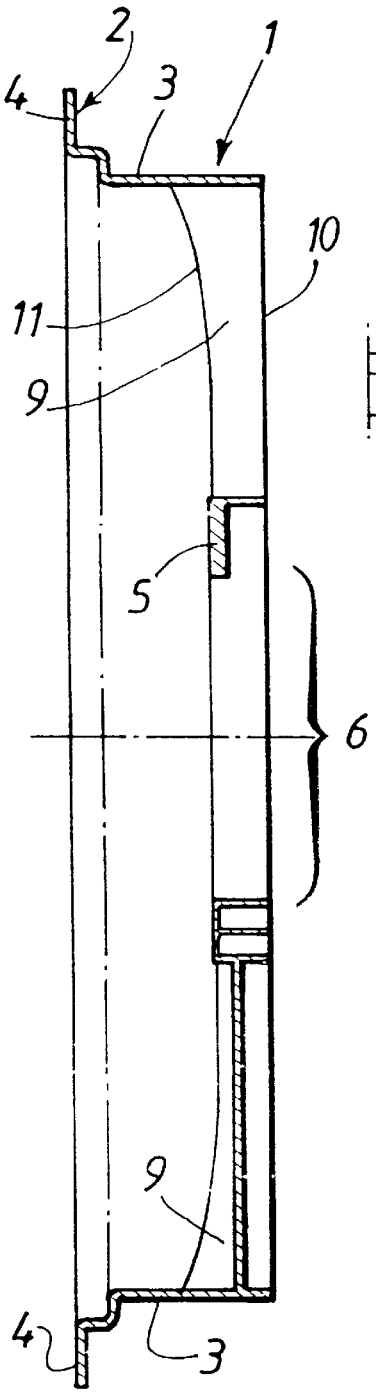
FIG. 2 shows an axial cross section through the stator assembly of FIG. 1, taken along the line II–II'.

Referring now to FIG. 1, a stator assembly 1 for a fan consists of a passage member 2, forming a fan shroud, the passage member being referred to hereinafter as an outer ring, a fan-supporting collar 5, referred to hereinafter as an inner ring, a support arm 8 and twenty stator blades 9. The outer ring is annular and, as can be seen in FIG. 2, has a generally cylindrical portion 3 and an outwardly-extending flange portion 4. The outer ring 2 accordingly defines a circular passage for the flow of air, which passage is concentric with the inner ring 5. The inner ring 5 as shown in FIG. 1, defines a generally circular aperture 6 within which may be secured a fan motor. The inner ring 5 has three outwardly-extending flange portions 7, each with a respective securing hole 80, for the motor. The inner ring 5 is maintained concentric with the air flow passage primarily by the support arm 8 which extends substantially radially of the passage. The support arm 8 has a generally U-shaped cross section (see FIG. 4) and is substantially rigid. The stator blades 9, for directing the flow of air extend between the inner ring 5 and the outer ring 2. Each stator blade 9 is substantially radial to the passage in the embodiment shown in FIG. 1, but other forms and orientations are possible as will be described later herein.

The stator blades straighten the air flow resulting from the movement of the fan. By so straightening the air flow, the speed of the flow is reduced, which reduces the acoustic losses. The overall effect of the stator blades is to reduce turbulence, and to maximise the total air flow which is distributed across the air flow passage. However, the stator blades also support the inner ring 5.

Figure 5:
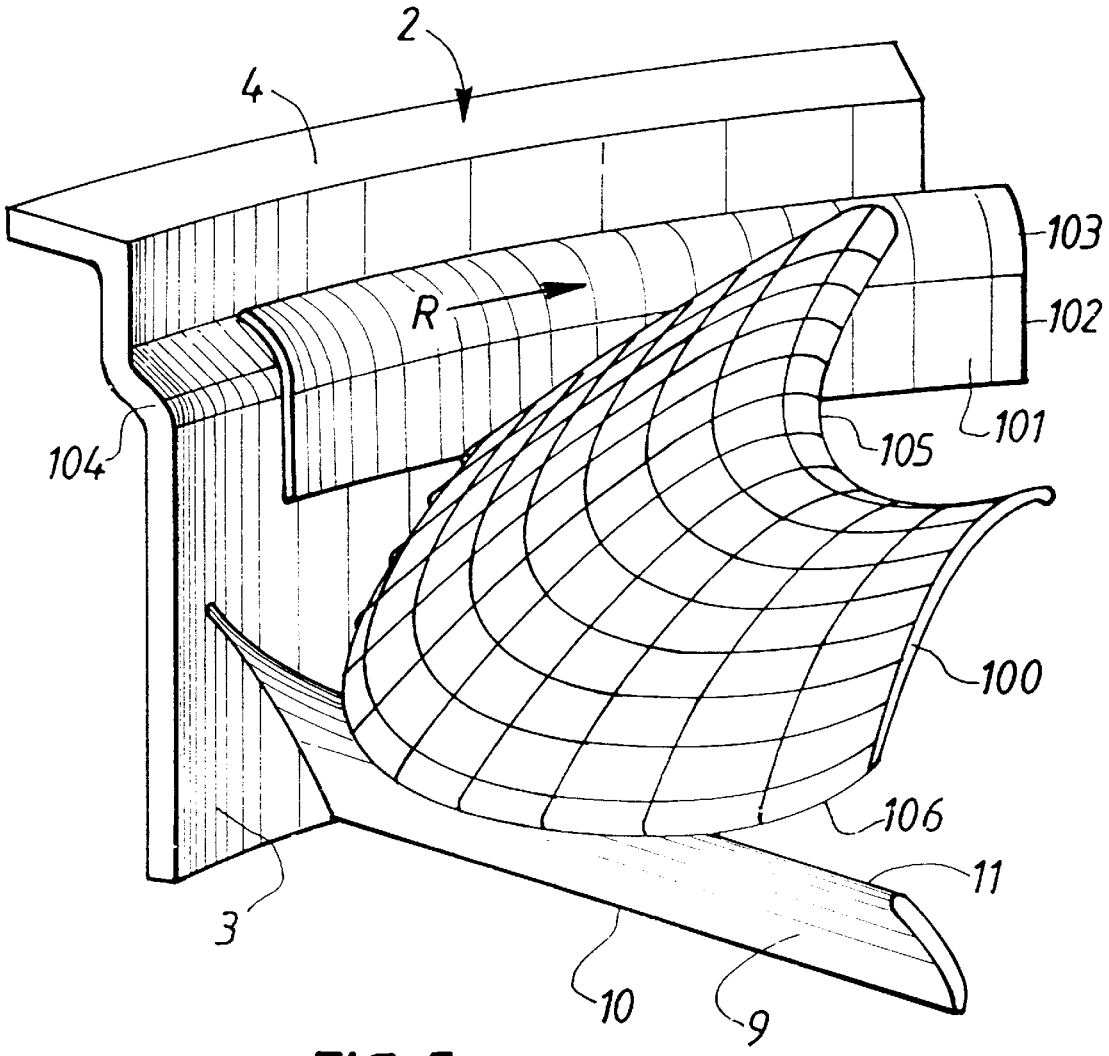
FIG. 5 shows an isometric view of a portion of a fan assembly comprising a stator assembly in accordance with the invention.
Figure 6:
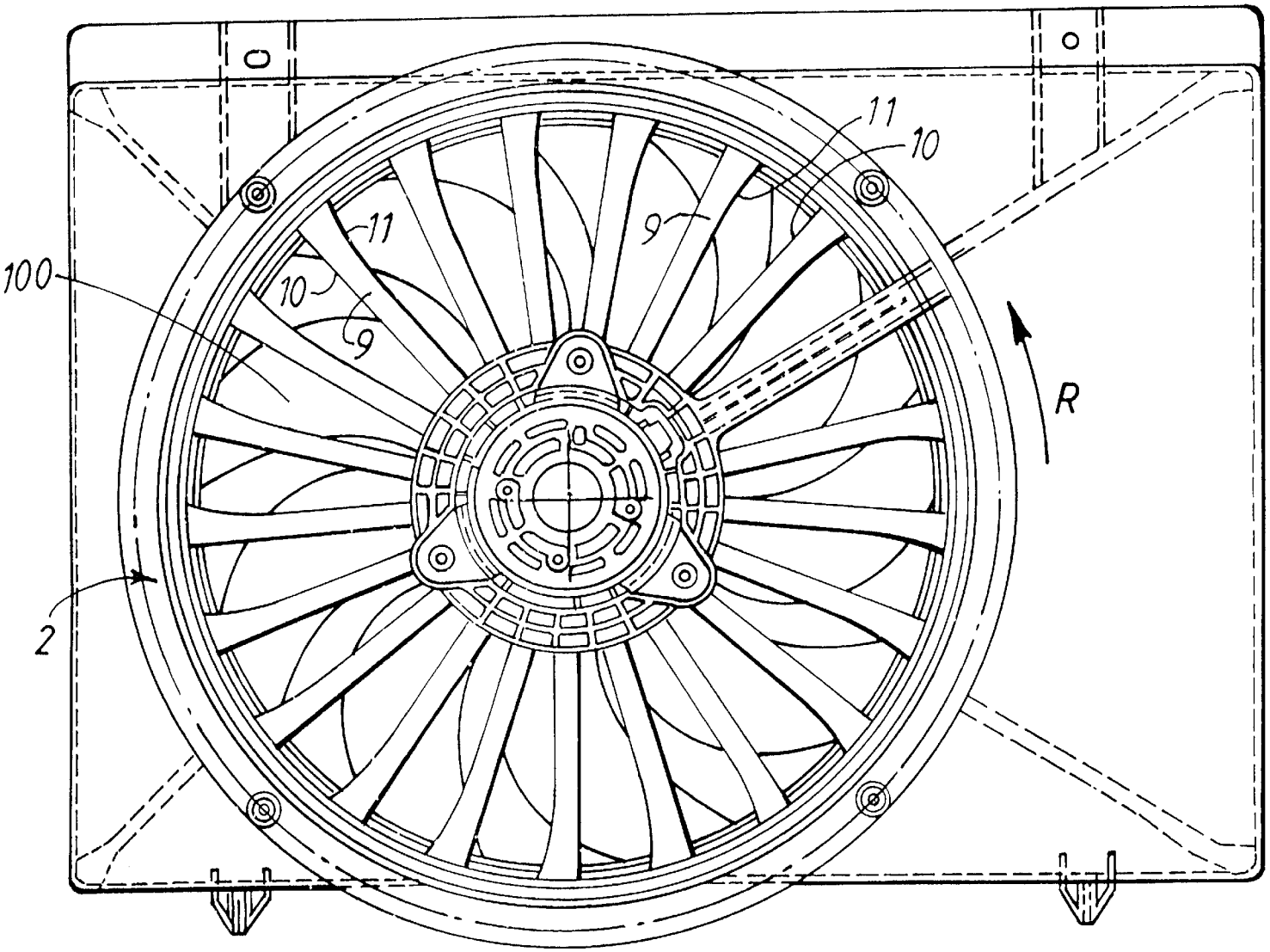
FIG. 6 shows an elevation of the fan assembly.
Figure 7:
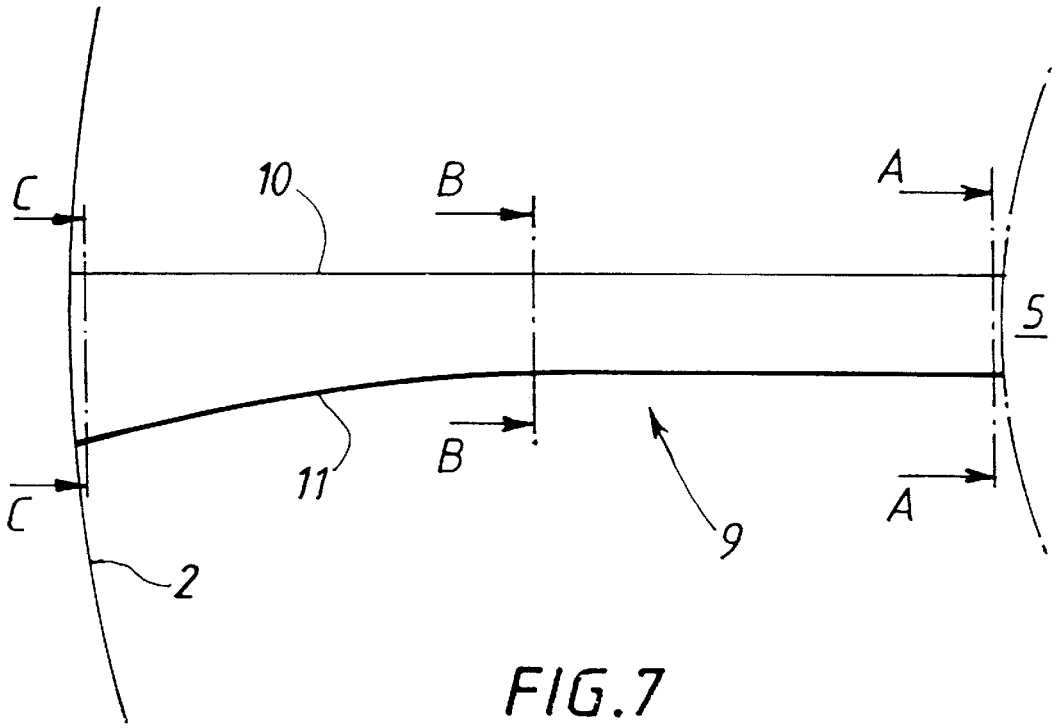
FIG. 7 shows a projection of a first form of stator blade onto a plane orthogonal to the axis of the stator of FIG. 1.

As shown in FIGS. 1, 5, 6 and 7 the stator blades of this embodiment each have one edge 10—the edge remote from the fan—which is substantially straight. The opposing edge 11—the edge nearest to the fan, as best seen in FIGS. 2, 5 and 7 is curved, as will be described later herein.

Figure 14:
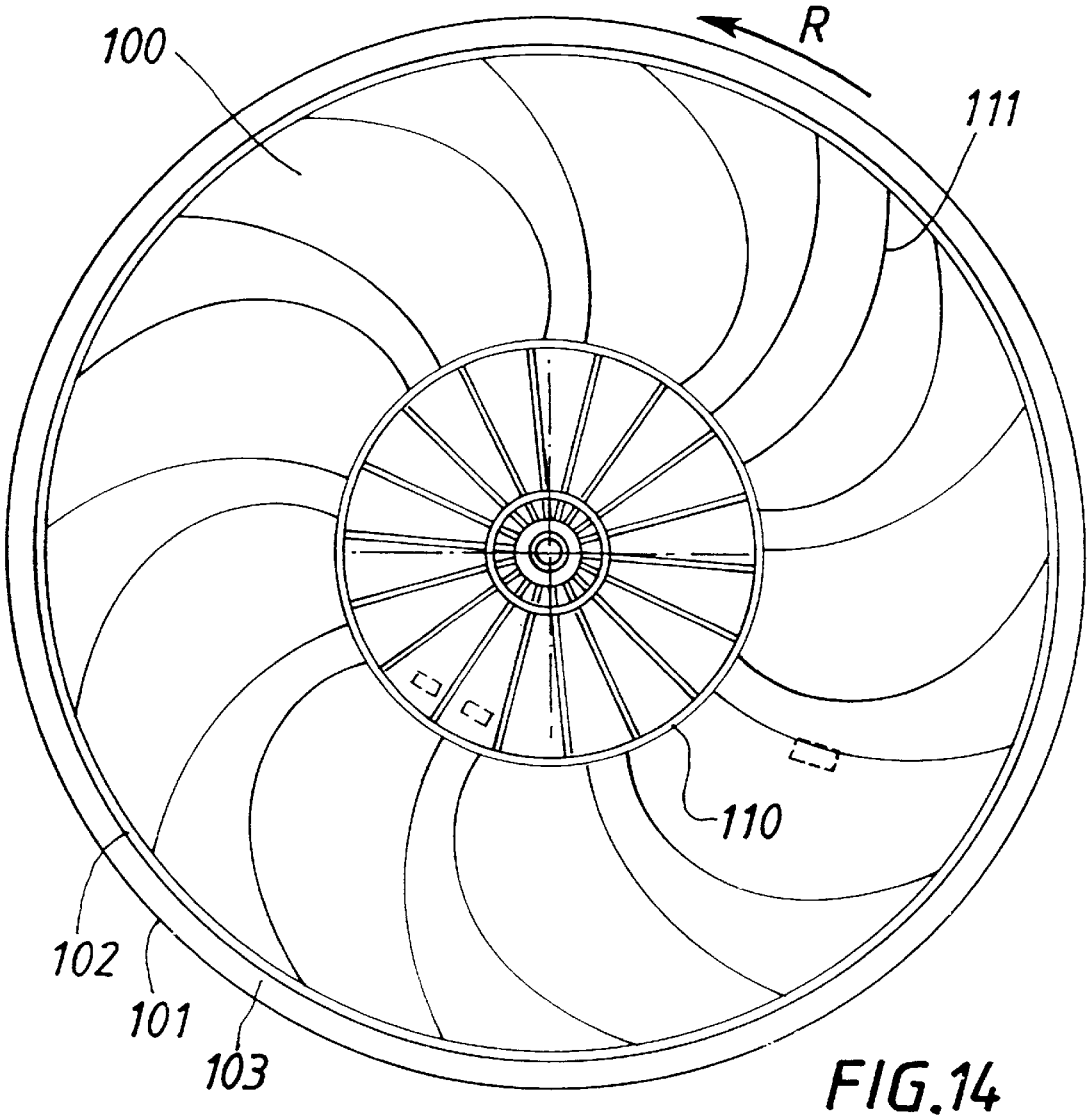
FIG. 14 shows a rear view of a fan usable with the invention.

Referring to FIGS. 5, 6 and 14, a fan has plural blades 100 secured at a root region thereof to a hub portion 110 of the fan so that the blades extend substantially radially of the rotational axis of the fan. The fan also has a blade tip support ring 101 which extends through the tip regions of each blade. The blade tip support ring, as seen in FIG. 5, has a generally cylindrical portion 102 and an outwardly-belled portion 103 as known in the art. The blade tip support ring rotates with the blades, and serves a number of functions, for example adding to the stiffness of the fan structure and, due to interaction with the passage member 2, reducing the reflux of air around the blade tips, the so-called "tip vortices". As can clearly be seen in FIG. 5, the outer ring or passage member 2 of the stator has an outwardly-curved portion 104 which generally conforms to the outward bell curve of portion 103 of the blade tip support ring so that the clearance between the blade tip support ring or passage member and the outer ring 2 is kept as small as possible.

The fan rotates in the direction "R", and is typically electrically driven. There may be a separate electric motor having a shaft for driving the fan, or the hub portion of the fan may be the rotor of the motor, or integrally attached to the rotor. A conventional commutator, or electronic commutation may be used in the event of dc operation.

As shown clearly in FIG. 5, a leading edge 105 of the fan blade 100 does not lie in the same plane as the trailing edge 106 of the fan blade. Specifically, at the blade tip support ring 101, the leading edge 105 is substantially coincident with the upper (as shown in FIG. 5) extremity of the blade tip support ring while the trailing edge 106 is substantially coincident with the lower (as shown in FIG. 5) extremity of the blade tip support ring 101. As seen in FIG. 14, the medial line 111 of each fan blade curves forwardly with respect to the direction of rotation R from the root region of the fan blade to the tip region. This form of fan blade is said to be forwardly-skewed. The particular fan blade 100 shown in FIG. 5 has a pitch, defined by the acute angle between the blade chord and the diametric plane, which varies along the radial extent of the fan blade. In one advantageous fan, the pitch remains approximately constant for the first 50% of the fan blade extent and then rises. Furthermore, the fan blade shown in FIG. 5 has a dihedral angle, namely the angle between the tangent plane to the fan blade at a point on the fan blade surface and a plane transverse to the axis of the fan, which varies along the extent of the fan blade. The particular form of the fan blade shown in FIGS. 5 and 14 is illustrative.

Figure 11:
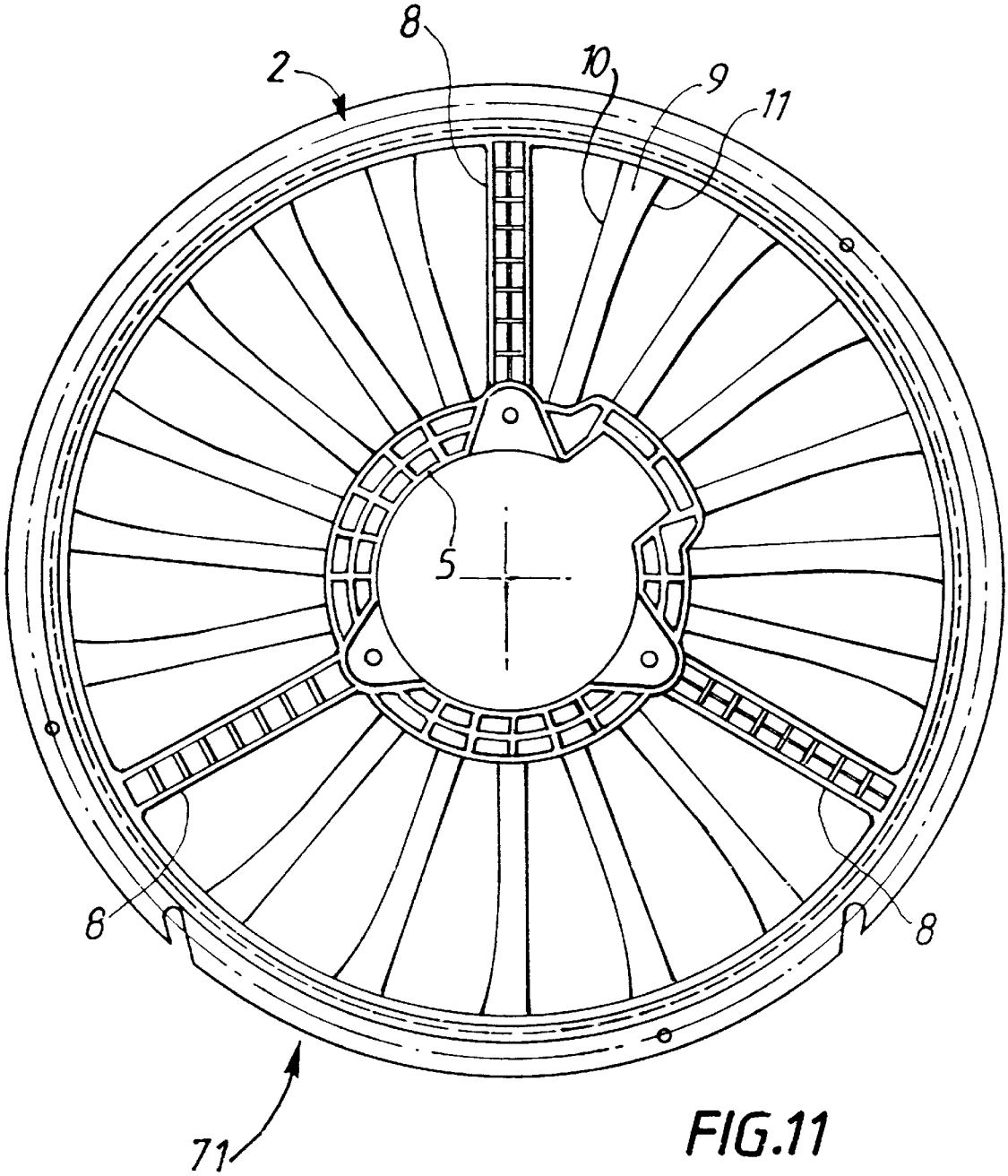
FIG. 11 shows a plan view of an alternative embodiment of a stator assembly in accordance with the invention.
Figure 15:
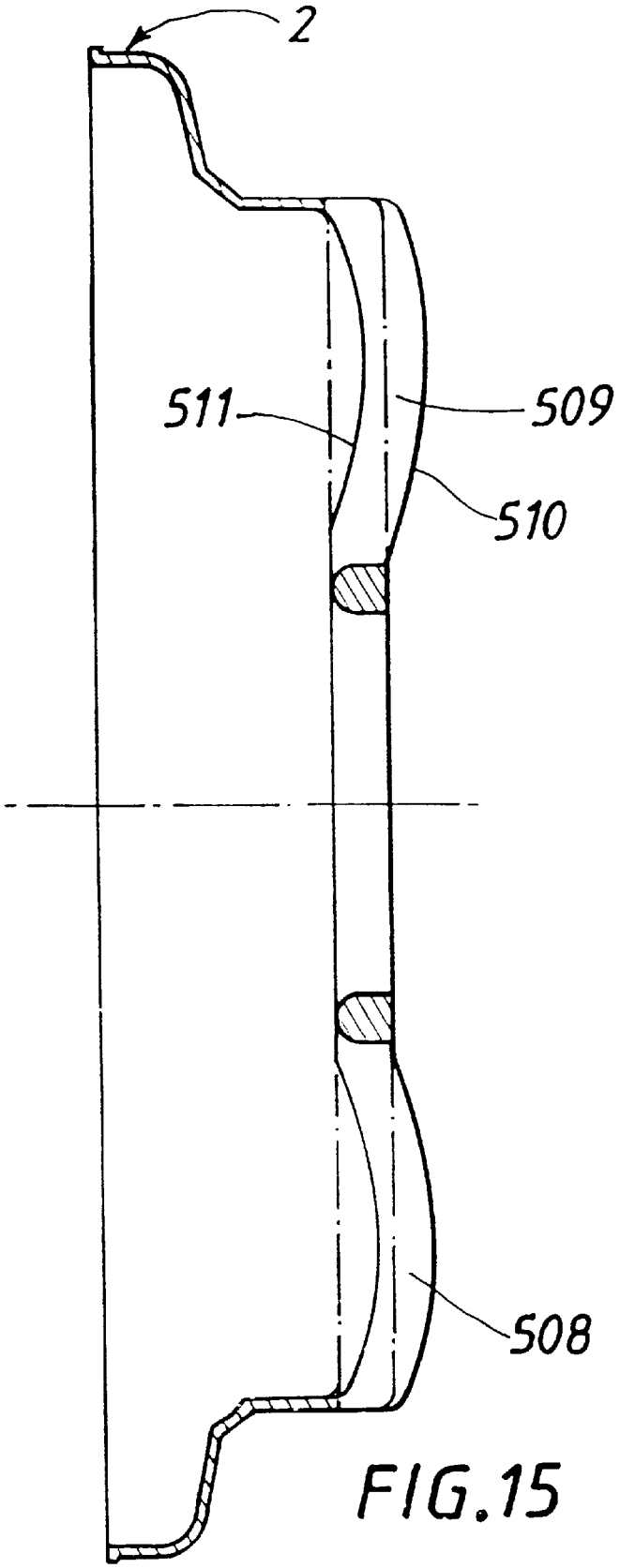
FIG. 15 shows a modification of the stator in which both edges of the stator blades, and of the support arms are correspondingly covered.

In this embodiment, the above-mentioned opposing edge 11 of each stator blade 9 defines a contour which corresponds to the contour produced by rotation of the trailing edge 106 of the fan blades. The projection of the leading edge of the stator blade onto a plane transverse to the fan axis corresponds to the projection onto that plane of the trailing edge of each fan blade. Thus, as the blade 100 of the fan rotates with respect to the stator blade 9, respective points on the trailing edge 106 of the fan blade and the closest opposing edge 11 of the stator blade which are in rotational coincidence are axially spaced by a substantially constant amount so that the projection of this closest edge of the stator blade onto a plane including the axis of rotation is curved. In this embodiment, the second edge 10 of the stator blade which is remote from the fan has a generally straight projection onto that plane. Moreover support arms of which the support arm 8 (FIG. 11 is illustrative has a generally straight projection onto that plane. In an alternative embodiment, shown in FIG. 15, the second edge 510 of the stator blade 509 has a projection onto that plane, which projection is curved in conformity with the projection of the closest edge 511. The support arm 508 has a curve to prevent fouling the fan blade. The curve may be identical to that of the stator blades, or may be differently curved so long as sufficient clearance is afforded. The stator blades are pitched in an opposite sense to the fan blades. Thus viewed outwardly from the hub, the chords of the fan blade i.e. at an anticlockwise acute angle to a plane transverse to the fan axis and passing through the trailing edge of the fan, whereas the chords of the stator blades lie at a clockwise acute angle to that plane.

Figure 3:
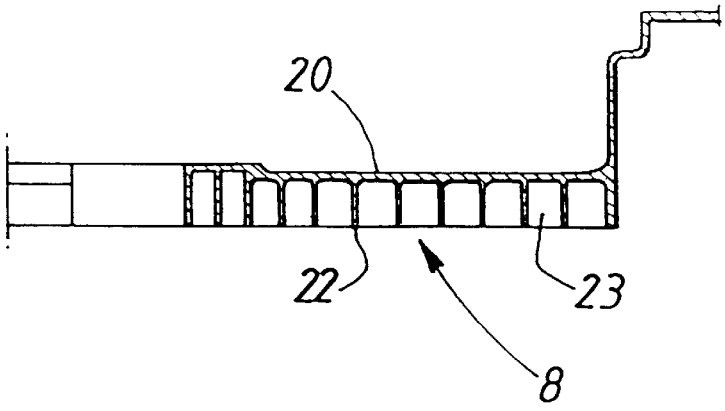
FIG. 3 shows a longitudinal cross section along line III–III' in the stator assembly of FIG. 1.
Figure 4:
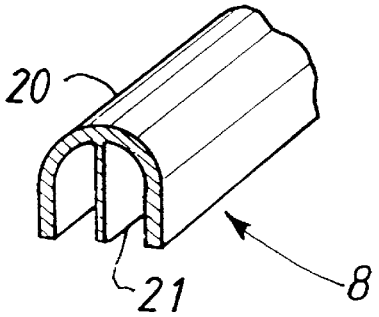
FIG. 4. shows a transverse cross section and partial perspective view of the support arm of FIG. 3 taken along line IV–IV' in FIG. 1.

Referring to FIGS. 3 and 4, the support arm 8 has a portion of an inverted U-shaped cross section to define a convex outer surface 20. Depending from the center of the U-shaped portion is a generally straight portion 21. As seen in FIG. 3, the support arm 8 has plural transverse partitions 22 spaced apart along the axis of the arm 8 and extending across the U-shaped portion 20, to define a plurality of downwardly-open boxes 23 for strength. The convex outer surface 20 allows smooth air flow thereover.

In use, the downwardly-depending portion 21 supports electrical wires which extend from the outer ring 2 to an associated fan motor.

Figure 8A:
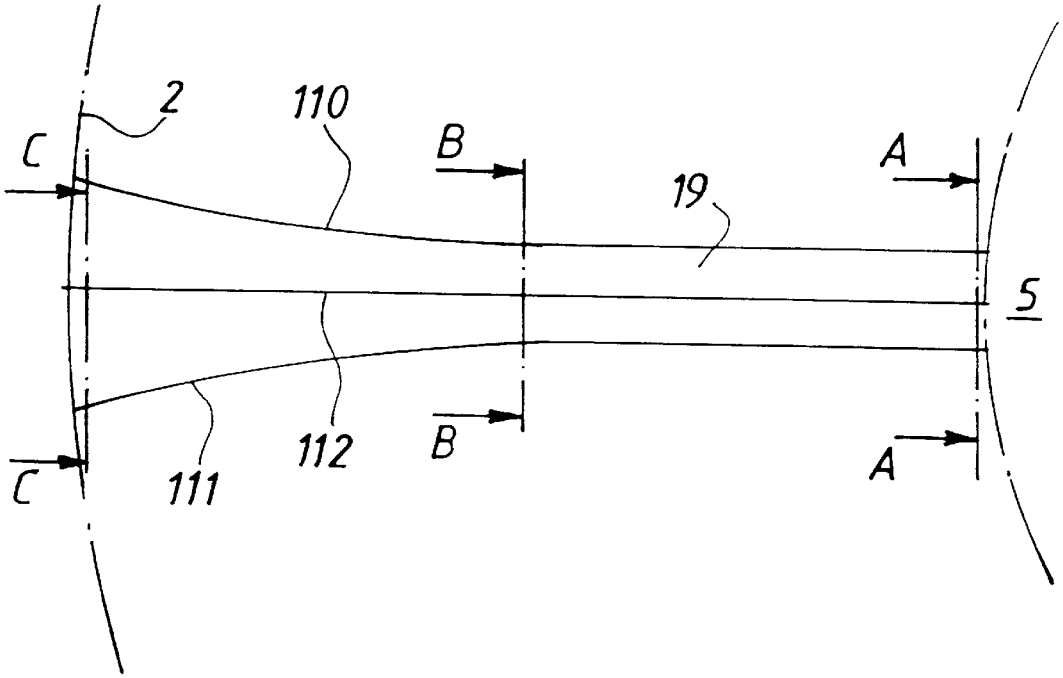
FIGS. 8A, 8B and 8C show projections, similar to FIG. 7, of second, third and fourth forms of stator blades.

Referring now to FIG. 8A, an alternative form of stator blade 19 will now be described. The stator blade 19, similar to stator blade 9, extends generally radially between the inner ring 5 and the outer ring 2. The edges 110,111 of the stator blade 19 are substantially parallel to one another for approximately the first 50% of the radial extent of the stator blade 19 from the inner ring 5 to the outer ring 2. Thereafter, the edges diverge substantially symmetrically from a radial medial line 112. Thus, at the outer ring 2, the circumferential extent of the stator blade 19 is approximately twice the circumferential extent of the stator blade at the inner ring 5. The chord length between the edges of each stator blade is substantially constant over the inner 50% of the extent of the blade, and increases with distance from the inner ring over the outer extent.

Figure 8B:
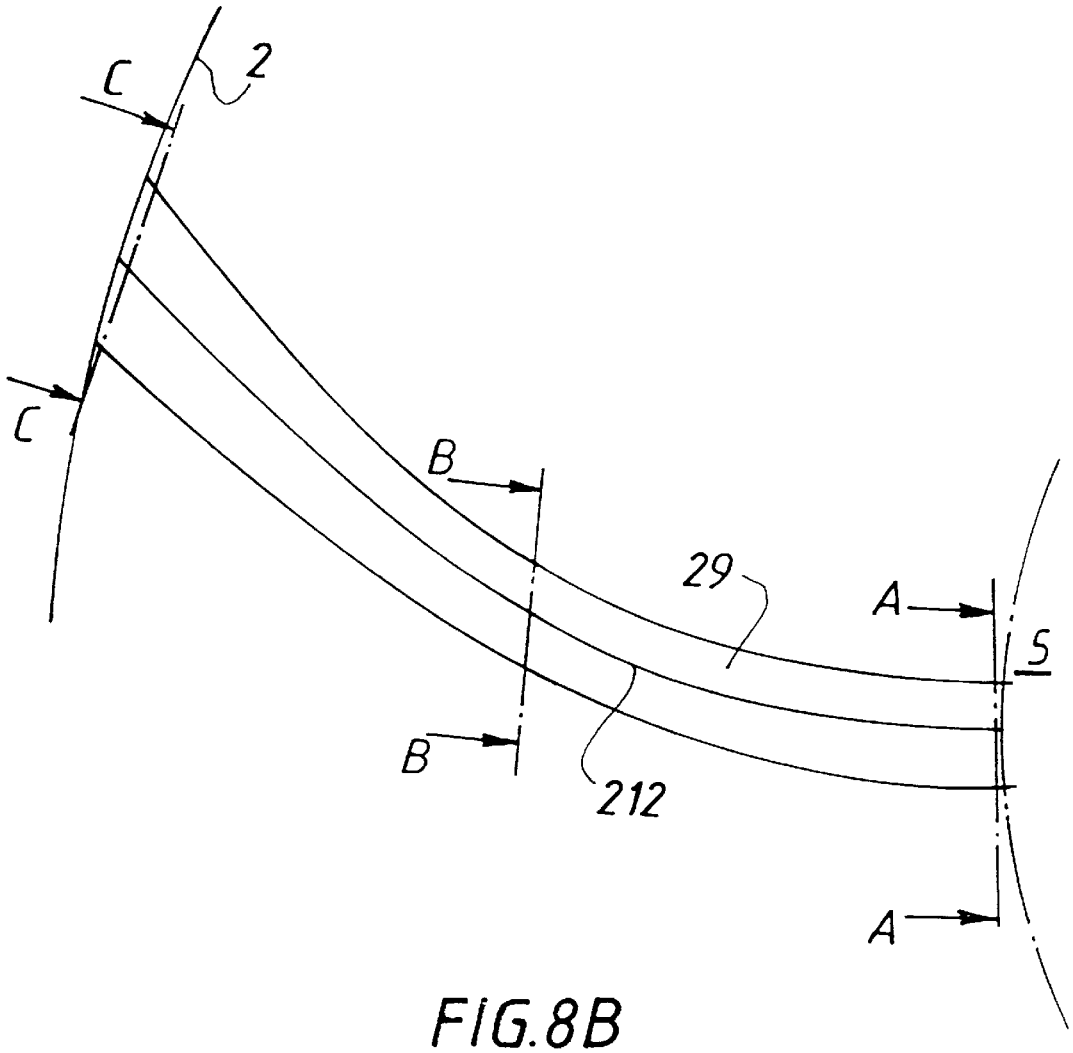

Turning now to FIG. 8B, a second alternative form of stator blade 29 will now be described, having a medial line 212 which extends radially in a root zone at the fan mount or inner ring 5 and then curving clockwise (viewed as seen in FIG. 8B), so that the intersection of the medial line 212 with the passage member or outer ring 2 is offset in a clockwise direction from the root zone. Stator blade 29 is said to be skewed in a clockwise direction.

Figure 8C:
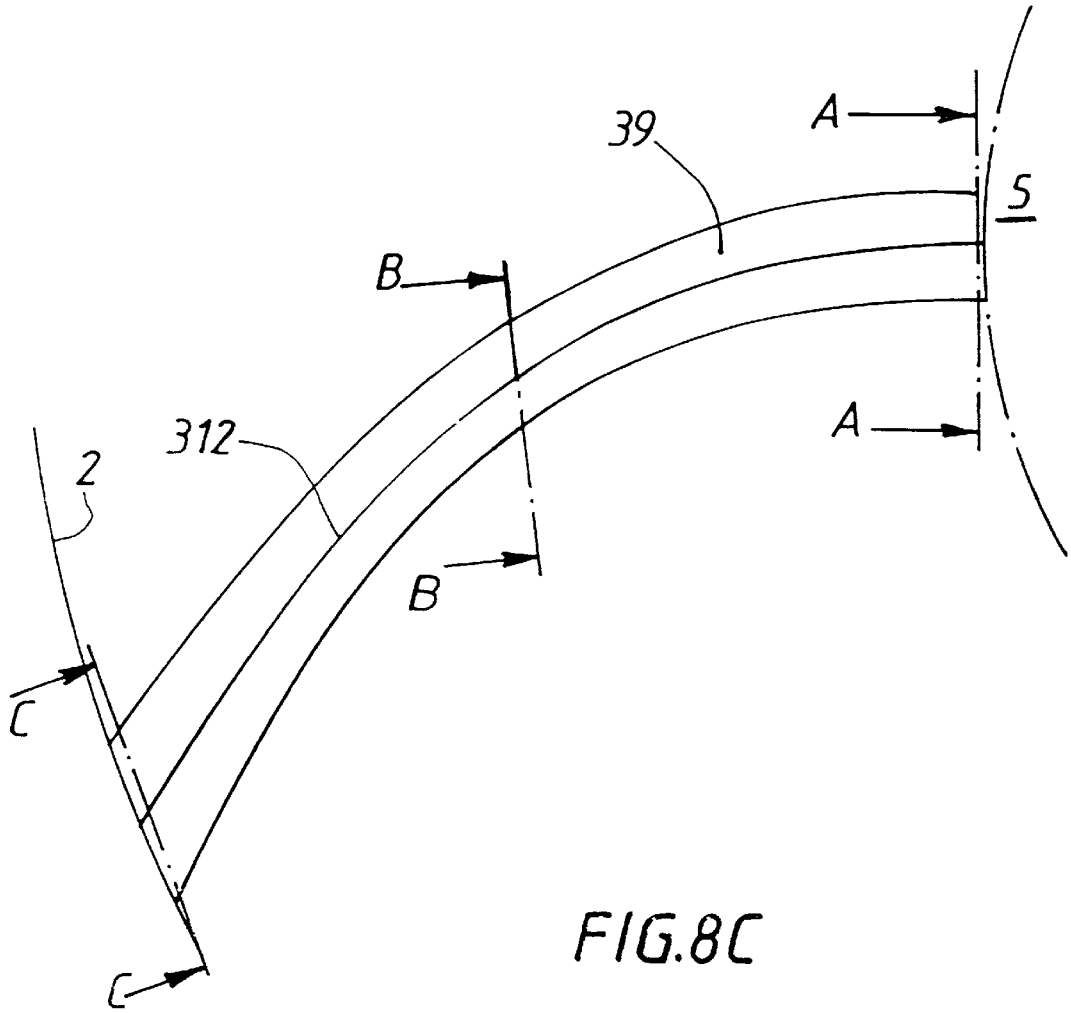

A third form of stator blade 39, shown in FIG. 8C, is skewed in an anticlockwise fashion. Thus, the medial line 312 of stator blade 39 curves anticlockwise (viewed as seen in FIG. 8C).

As with stator blade 9 shown in FIG. 7, the stator blade 9 has a constant chord length over approximately the inner 50% of the blade and the chord length increases with distance from the inner ring in the outer part.

Figure 9A:
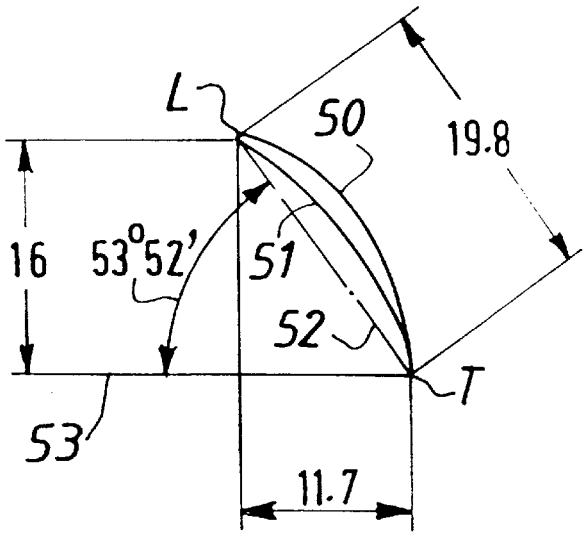
FIGS. 9A–9C show transverse cross sectional views through a stator blade of FIG. 7.
Figure 9B:
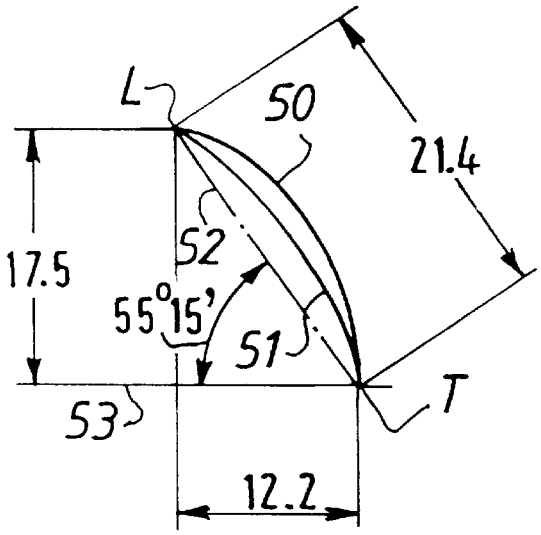
Figure 9C:
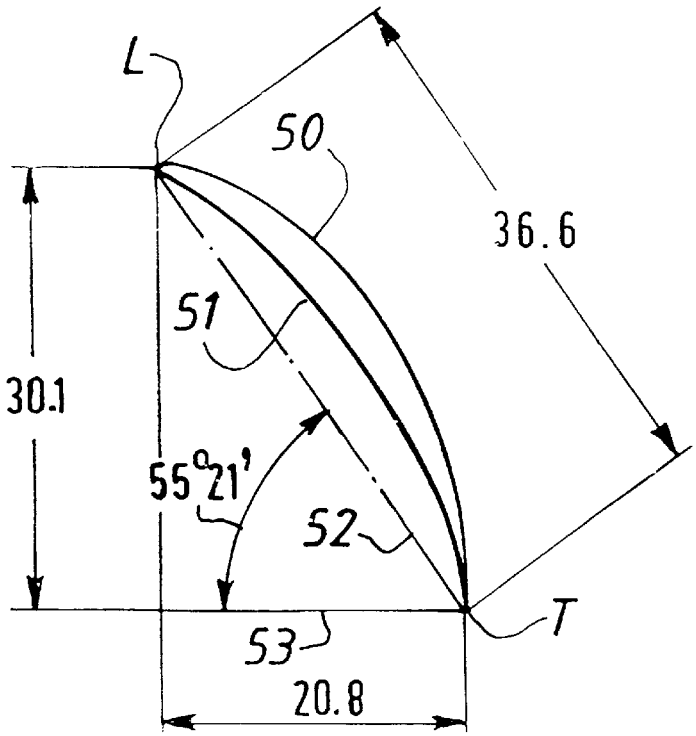

FIGS. 9A, 9B and 9C show respective transverse cross-sectional views through stator blade 9 of FIG. 7 taken along lines A–A', B–B' and C–C' in FIG. 7. The stator blades of FIGS. 8A, 8B and 8C have similar cross-sections to those of FIGS. 9A–C. Line A–A' is immediately adjacent the inner ring 5, line B–B' is 50% along the extent of the stator blade, and line C–C' is immediately adjacent the outer ring 2.

Figure 10A:
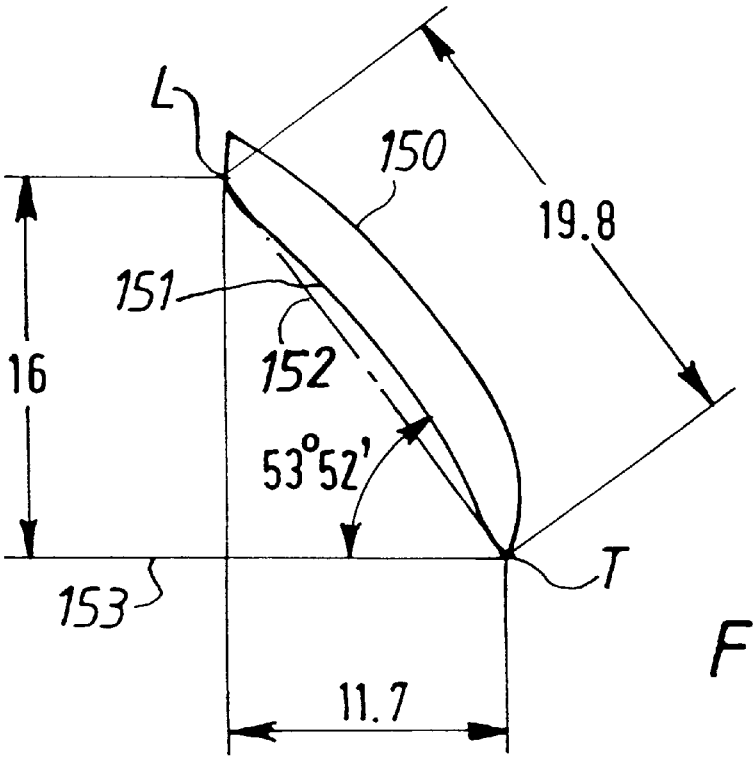
FIGS. 10A–10C show transverse axis sectional views of an alternative stator blade, having an aerofoil cross-section.
Figure 10B:
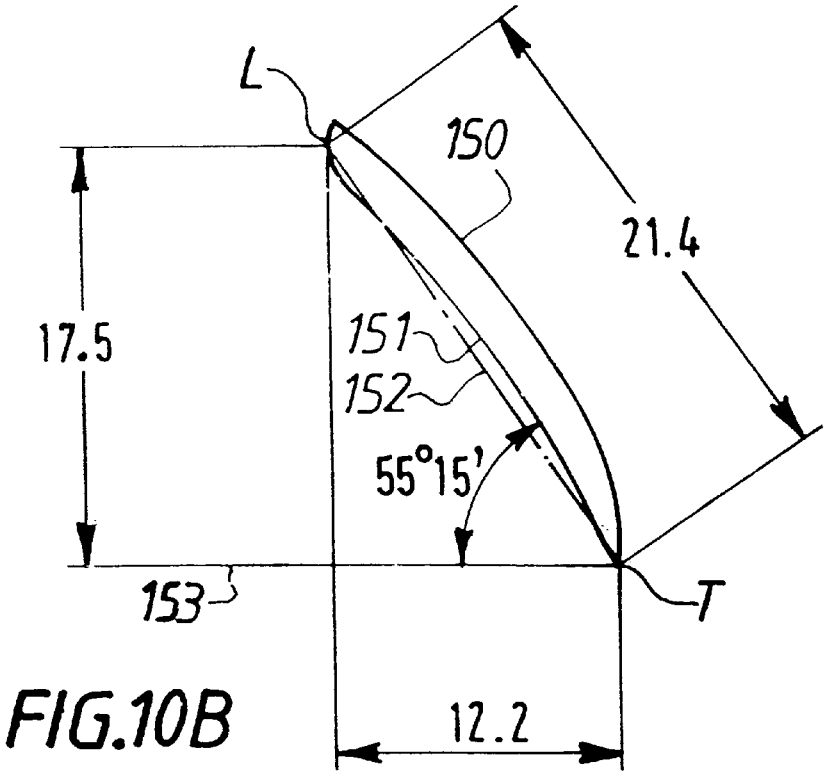
Figure 10C:
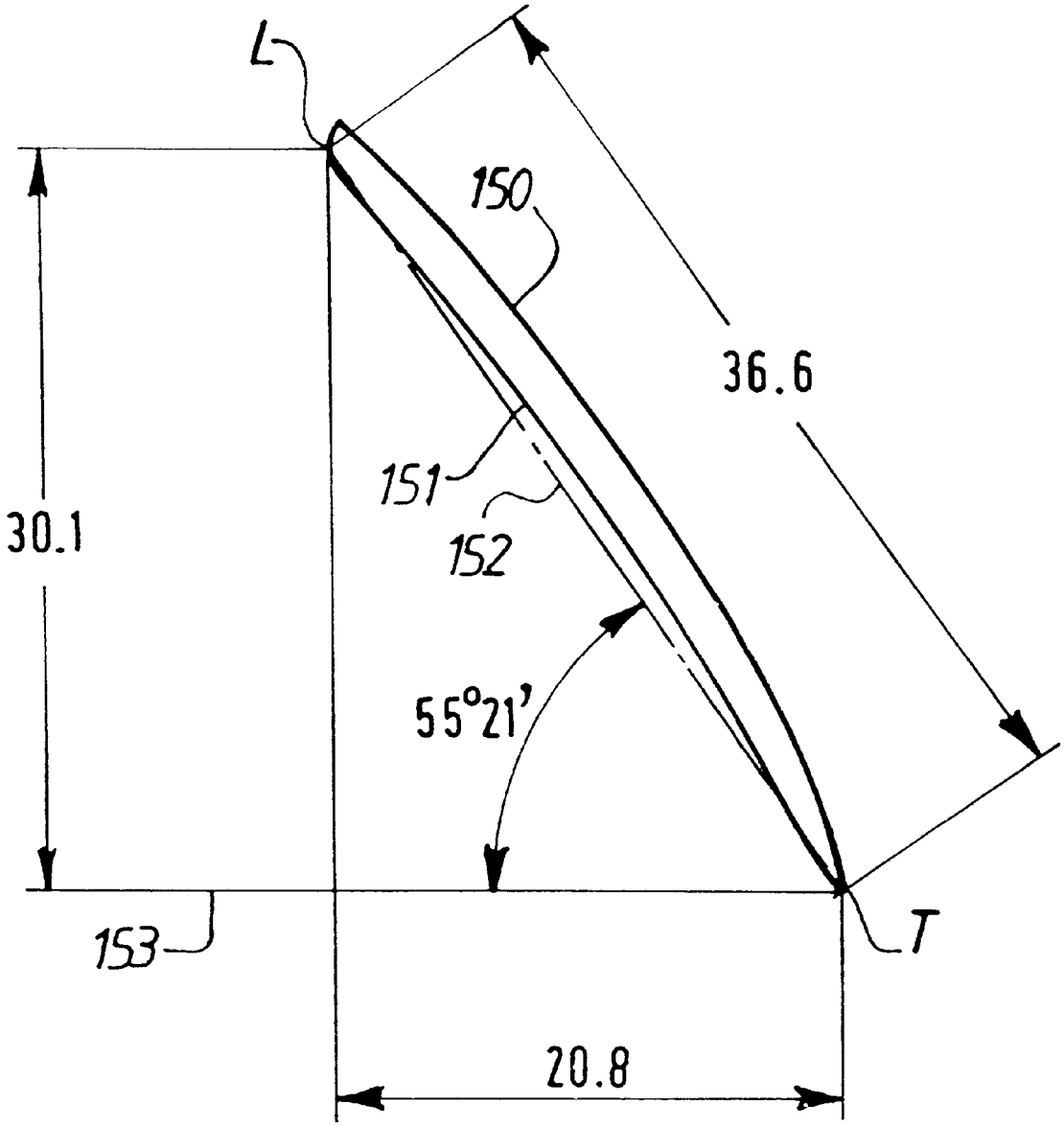

Referring to FIGS. 9A–9C, the cross-section of each stator blade viewed radially outwardly, has a convex first surface 50 which in use is axially directed towards an associated fan. The stator blade has a concave second surface 51 opposite the first surface 50 and thus remote from the associated fan. The stator blade has a chord 52, extending between the leading edge L of the blade and the trailing edge T of the blade, where the leading edge is nearer and the trailing edge is more remote from the fan. The chord 52 makes an acute angle in an anticlockwise sense, with a plane 53 which is transverse to the passage defined by the outer ring 2. Referring to FIGS. 10A–10C, a second embodiment of the stator blade is shown. Comparing the respective FIGS. 10A–10C with the respective FIGS. 9A–9C, it will be seen that the major dimensions of the first and second forms of stator blade are substantially the same. However, the second form of stator blade, shown in FIGS. 10A–10C has a generally thicker cross-section which corresponds to an aerofoil shape. The second stator blade has a convex first surface 150 closest to the associated fan, a concave second surface 151 opposite the first surface 150 and remote from the fan. The chord of the second stator blade is referenced 152 and the chord makes an acute angle with a plane 153 which is transverse to the passage defined by the outer ring. In the particular embodiments shown in FIGS. 9A–9C and FIGS. 10A–10C, the acute angle between chord 52, 152 and plane 53, 153 increases slightly along the stator blade from the inner ring to the outer ring, and the length of the chord 52, 152 remains substantially constant over the inner 50% of the stator blade and then increases to a maximum at the outer ring. Other forms are however possible.

Referring to FIG. 11, a second embodiment of a stator assembly 71 is shown. The stator assembly 71 is somewhat similar to that described with respect to FIG. 1, except for the provision of three support arms 8, each extending radially between the inner ring 5 and the outer ring 2. This arrangement is advantageous where increased mechanical strength is required, for example where the application concerned calls for a powerful fan drive motor.

In the arrangement of FIG. 1, there are provided twenty stator blades and one support arm. Referring to FIG. 11, one alternative stator has seventeen stator blades and three support arms. For acoustic reasons, it is desirable to have an odd number of members extending between the fan mount 5 and the outer ring 2 of the shroud, to reduce the occurrence of acoustic resonance. In especially critical applications it may be desirable to use a prime number of stator blades to further reduce such resonances.

Figure 12:
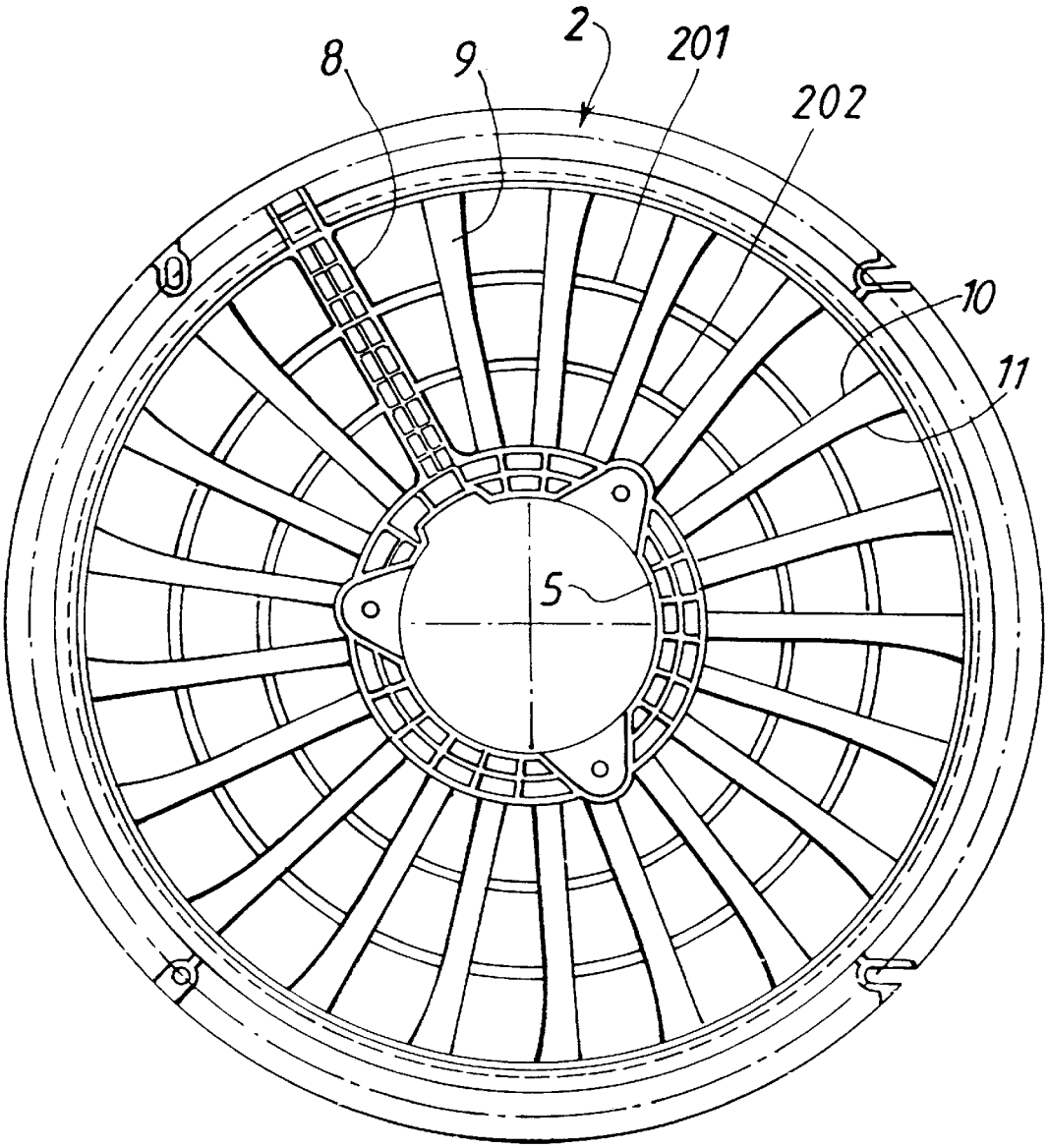
FIG. 12 shows a modified plan view of a stator assembly having two concentric support rings linking the stator blades.
Figure 13:
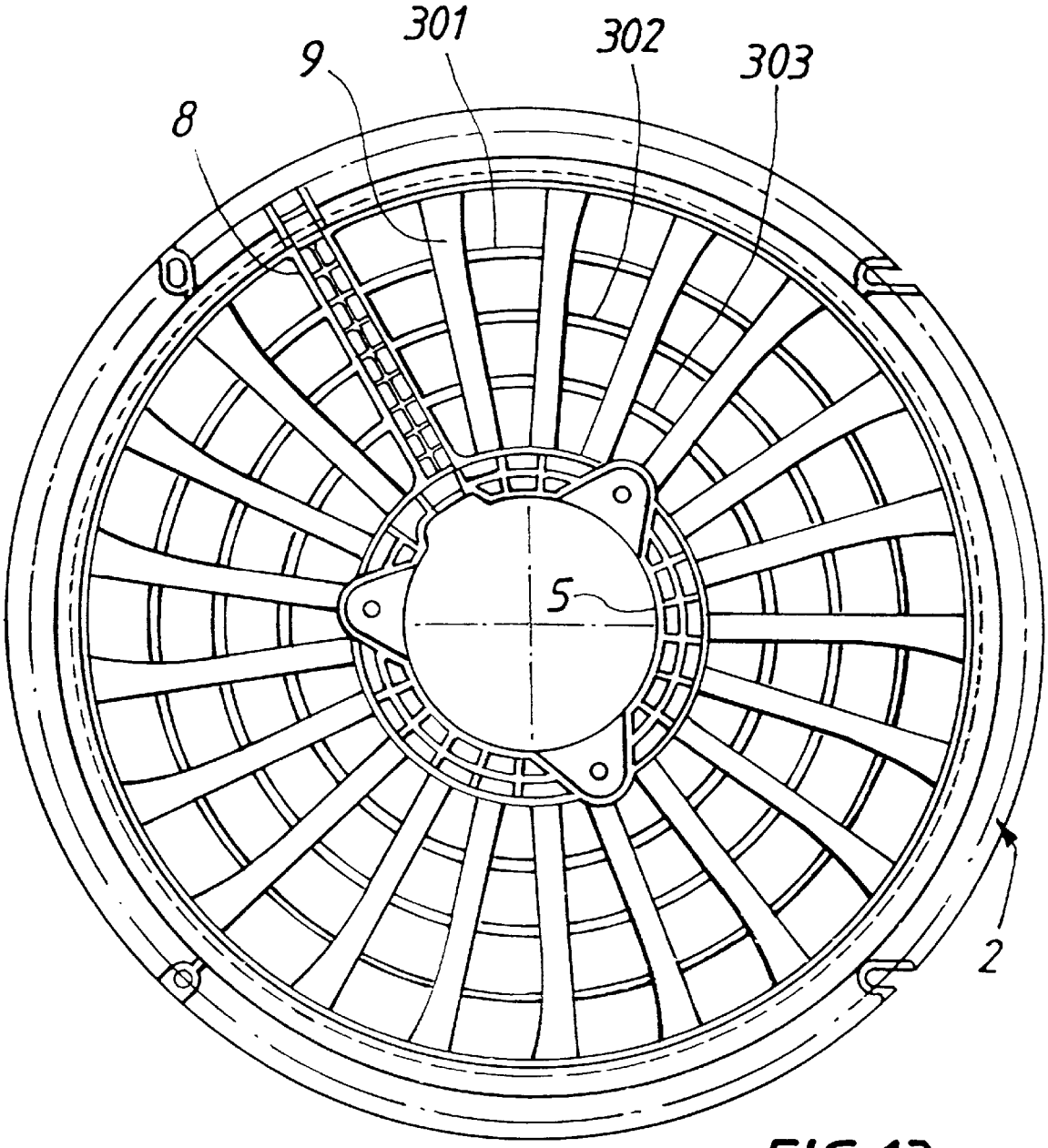
FIG. 13 shows a view similar to FIG. 11 but having three support rings.

In some situations, it may be advantageous to provide additional support rings between the inner ring 5 and the outer ring 2. FIG. 12 shows a plan view of a modified stator, generally similar to the stator assembly of FIG. 1 but having two reinforcing rings 201,202 secured to the support arm 8 and each of the stator blades 9. The two rings are disposed respectively approximately one third and approximately two thirds of the way along the stator blades, and are concentric with the inner and outer rings 5, 2. FIG. 13 shows a generally similar arrangement to that of FIG. 12 but having three rings 301,302,303 connecting the support arm 8 and each of the stator blades 9. Once again, the rings are concentrically disposed with the inner and outer rings 5, 2, and are generally regularly spaced along the stator blades. It would however be possible to provide other spacings of the rings, and this may be especially useful where the stator blades have thin regions along their length, or are especially prone to vibration at some point along their lengths.

A stator of the invention may be disposed upstream or downstream of the fan, as required. The fan used with the stator need not have a tip support ring.

What is claimed is:

1. A stator assembly for a fan, comprising a passage member defining a passage having an axis, and a radius for flow of air due to the fan, a fan mount for the fan having an axis to establish a plane transverse to the passage member and orthogonal to the fan axis, at least one support arm extending between the passage member and the fan mount for supporting the fan mount with respect to the passage, a plurality of air flow directing members each having respective medial lines extending between the passage member and the fan mounts and wherein chords of each air flow directing member make respective acute angles with a plane transverse to the passage and orthogonal to the fan axis.

2. A stator assembly as claimed in claim 1 wherein the passage member is an outer ring member, thereby defining a circular air flow passage and the fan mount is substantially concentric within said outer ring member.

3. A stator assembly as claimed in claim 2 wherein the fan mount is a substantially annular inner ring member for supporting a drive shaft of said fan.

4. A stator assembly as claimed in claim 3 wherein the fan comprises an electric motor having said drive shaft, and the inner ring member engages a portion of the electric motor.

5. A stator assembly as claimed in claim 2 further comprising at least one support ring connecting together the plurality of blade support members, and disposed between the fan mount and the outer ring member.

6. A stator assembly as claimed in claim 1 wherein each air flow directing member has a transverse cross-section of concavo-convex form.

7. A stator assembly as claimed in claim 1 wherein said at least one support arm consists of one support arm only, and the support arm is adapted to carry electrical wiring for the fan drive motor.

8. A stator assembly as claimed in claim 1 wherein there is provided a plurality of support arms, and at least one of the support arms is adapted to carry electrical wiring for the fan drive motor.

9. A stator assembly as claimed in claim 1 wherein a projection of each air flow directing member onto the plane transverse to the passage and orthogonal to the fan axis has a medial line which extends radially of the air flow passage, and respective edges which are mirror symmetrical about said medial line.

10. A stator assembly as claimed in claim 1 wherein a projection of the medial line of each air flow directing member onto the plane transverse to the passage and orthogonal to the fan axis curves with respect to the respective radius of said passage.

11. A stator assembly as claimed in claim 1 further comprising a support member extending between two of said air flow directing members.

12. A stator assembly for a fan, comprising a passage member defining a passage for flow of air due to the fan, a fan mount for the fan, at least one support arm extending between the passage member and the fan mount for supporting the fan mount with respect to the passage, and a plurality of air flow directing members extending between the passage member and fan mount, wherein chords of each air flow directing member make respective acute angles with a plane transverse to the passage and orthogonal to the fan axis and said acute angles vary along the air flow directing member, each of the air flow directing members having a substantially constant chord length over about the first 50% of the distance between the fan mount and the passage member, and thereafter the chord length increases.

* * * * *

UNITED STATES PATENT AND TRADEMARK OFFICE

CERTIFICATE OF CORRECTION

PATENT NO. : 6,139,265
DATED : October 31, 2000
INVENTOR(S) : Ahmad Alizadeh

It is certified that error appears in the above-identified patent and that said Letters Patent is hereby corrected as shown below:

Claim 1,
Line 10, "mounts" should read -- mount --; and delete "and" after "mount,".
Line 12, after "axis" insert --, each of the air flow directing members having substantially constant chord length over about the first 50% of the distance between the fan mount and the passage member, and thereafter the chord increases --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*